US011598500B2

(12) United States Patent
Cai et al.

(10) Patent No.: US 11,598,500 B2
(45) Date of Patent: Mar. 7, 2023

(54) DOWNLIGHT APPARATUS

(71) Applicant: XIAMEN ECO LIGHTING CO. LTD., Xiamen (CN)

(72) Inventors: Lixian Cai, Xiamen (CN); Xiaoliang Wen, Xiamen (CN); Linhua Wang, Xiamen (CN)

(73) Assignee: XIAMEN ECO LIGHTING CO. LTD., Xiamen (TW)

( * ) Notice: Subject to any disclaimer, the term of this patent is extended or adjusted under 35 U.S.C. 154(b) by 0 days.

(21) Appl. No.: 17/486,792

(22) Filed: Sep. 27, 2021

(65) Prior Publication Data

US 2022/0099259 A1 Mar. 31, 2022

(30) Foreign Application Priority Data

| | | |
|---|---|---|
| Sep. 25, 2020 | (CN) | 202022143845.X |
| Sep. 25, 2020 | (CN) | 202022143952.2 |
| Sep. 25, 2020 | (CN) | 202022144124.0 |
| Sep. 25, 2020 | (CN) | 202022144592.8 |
| Sep. 25, 2020 | (CN) | 202022144716.2 |
| Sep. 29, 2020 | (CN) | 202022193830.4 |
| Sep. 29, 2020 | (CN) | 202022194214.0 |
| Sep. 29, 2020 | (CN) | 202022194235.2 |
| Sep. 29, 2020 | (CN) | 202022199767.5 |

(51) Int. Cl.

| | |
|---|---|
| ***F21S 8/02*** | (2006.01) |
| ***F21V 23/00*** | (2015.01) |
| ***F21V 17/16*** | (2006.01) |
| ***F21V 23/06*** | (2006.01) |
| ***F21V 21/04*** | (2006.01) |

(52) U.S. Cl.

CPC ..... *F21S 8/02* (2013.01); *F21V 17/16* (2013.01); *F21V 21/04* (2013.01); *F21V 23/003* (2013.01); *F21V 23/06* (2013.01)

(58) Field of Classification Search

CPC . D21S 8/02; D21S 8/026; F21V 17/16; F21V 21/04; F21V 23/003; F21V 23/06; F21V 21/042; F21V 23/008; F21V 25/12; F21S 8/02; F21S 8/026

See application file for complete search history.

(56) References Cited

U.S. PATENT DOCUMENTS

| | | | | |
|---|---|---|---|---|
| 10,760,774 | B1 * | 9/2020 | Zheng | F21V 29/70 |
| 11,060,705 | B1 * | 7/2021 | Danesh | F21V 17/10 |

(Continued)

FOREIGN PATENT DOCUMENTS

| | | | | |
|---|---|---|---|---|
| GB | 2563040 | * 12/2018 | ..... | F21S 8/02 |

*Primary Examiner* — Peggy A Neils

(74) *Attorney, Agent, or Firm* — Chun-Ming Shih; Lanway IPR Services

(57) ABSTRACT

A downlight apparatus includes a light source, a driver, a light holder, a metal rim and two elastic arms. The driver converts an external power to a driving current to be used by the light source. The light holder stores the light source in an holder space of the light holder. The light holder is placed inside a cavity of a ceiling. The metal rim is connected to a bottom side of the light holder. The two elastic arms are attached to one of the metal rim and the light holder for elastically pressing the metal rim to engage an cavity edge of the cavity of the ceiling for concealing the cavity and preventing an accidental fire to escape from the cavity of the ceiling to outside of the cavity of the ceiling.

18 Claims, 11 Drawing Sheets

(56) References Cited

U.S. PATENT DOCUMENTS

| | | | | |
|---|---|---|---|---|
| 11,231,167 | B2 * | 1/2022 | Jeswani | H05B 45/10 |
| 2013/0100650 | A1 * | 4/2013 | Beregszaszi | F21S 8/026 29/401.1 |
| 2016/0234414 | A1 * | 8/2016 | Chen | F21V 33/0056 |
| 2018/0202634 | A1 * | 7/2018 | Farzan | F21V 23/001 |
| 2020/0393119 | A1 * | 12/2020 | Portinga | F21K 9/23 |

* cited by examiner

DOWNLIGHT APPARATUS

FIELD

The present invention is related to a downlight apparatus, and more particularly related to a downlight apparatus with fire protection function.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Fire accident is very dangerous for daily life. People need to install various light devices to ceilings.

Sometimes, fire moves and escapes from cavities for installing downlight devices.

Therefore, it is beneficial if a new design of downlight device that also solves the problem of fire safety. Fire accident is very dangerous for daily life. People need to install various light devices to ceilings.

Sometimes, fire moves and escapes from cavities for installing downlight devices.

Therefore, it is beneficial if a new design of downlight device that also solves the problem of fire safety. Fire accident is very dangerous for daily life. People need to install various light devices to ceilings.

Sometimes, fire moves and escapes from cavities for installing downlight devices.

Therefore, it is beneficial if a new design of downlight device that also solves the problem of fire safety. Fire accident is very dangerous for daily life. People need to install various light devices to ceilings.

Sometimes, fire moves and escapes from cavities for installing downlight devices.

Therefore, it is beneficial if a new design of downlight device that also solves the problem of fire safety.

SUMMARY

In some embodiments, a downlight apparatus includes a light source, a driver, a light holder, a metal rim and two elastic arms.

The driver converts an external power to a driving current to be used by the light source.

The light holder stores the light source in an holder space of the light holder.

The light holder is placed inside a cavity of a ceiling.

The metal rim is connected to a bottom side of the light holder.

The two elastic arms are attached to one of the metal rim and the light holder for elastically pressing the metal rim to engage an cavity edge of the cavity of the ceiling for concealing the cavity and preventing an accidental fire to escape from the cavity of the ceiling to outside of the cavity of the ceiling.

In some embodiments, the downlight apparatus may also include a driver box for connecting to an external power wire to receive the external power.

The driver box conceals the driver.

In some embodiments, the driver box is separate from the light holder.

The driver is electrically connected to the light source via an internal power wire.

In some embodiments, the internal power wire includes a first part and a second part connected with a plugging structure.

In some embodiments, the external power wire is inserted into the driver box to connect to the driver.

The driver box is made of metal material.

In some embodiments, the driver box is stacked above the light holder.

In some embodiments, the driver box is attached to the light holder with a buckle structure.

In some embodiments, the driver box conceals a top side of the light holder to further prevent the accidental fire to escape from the cavity of the ceiling.

In some embodiments, a spreader cup is attached to the metal rim for guiding a light from a light opening of the metal rim to a different direction.

In some embodiments, the spreader cup has an inner reflective layer for guiding the light to change to the different direction.

In some embodiments, the light holder is made of metal material, wherein the light holder and the metal rim together form a concealing surface for preventing any accidental fire escape from the cavity of the ceiling to pass the concealing surface.

In some embodiments, the metal rim has a lateral wall for mounting the light holder.

In some embodiments, the downlight apparatus may also include a temperature sensor for detecting an ambient temperature.

When the ambient temperature is detected higher than a threshold, the light source is turned off automatically.

In some embodiments, an indicator shows a warning message when the detected ambient temperature is over the threshold.

In some embodiments, an external emergency light device is activated by the driver wirelessly when the detected ambient temperature is over the threshold.

In some embodiments, the downlight apparatus may also include a light passing cover.

The metal rim defines a light opening and the light passing cover conceals the light opening.

In some embodiments, a connection of the light passing cover to the metal rim has a ladder structure for preventing water to move into the light holder.

In some embodiments, the elastic arm has a spring head and an extending arm.

The spring head is attached to an U shape bracket.

In some embodiments, the spring head has a protruding tail for engaging the U shape bracket so that when the extending arm is rotated along an axis of the spring head, an elastic force is generated for elastically pressing the metal rim to engage the cavity edge of the cavity of the ceiling.

In some embodiments, a metal head sink is attached on a top side of the light holder to further prevent fire to penetrate from the top side of the light holder.

DETAILED DESCRIPTION

Figure 1:
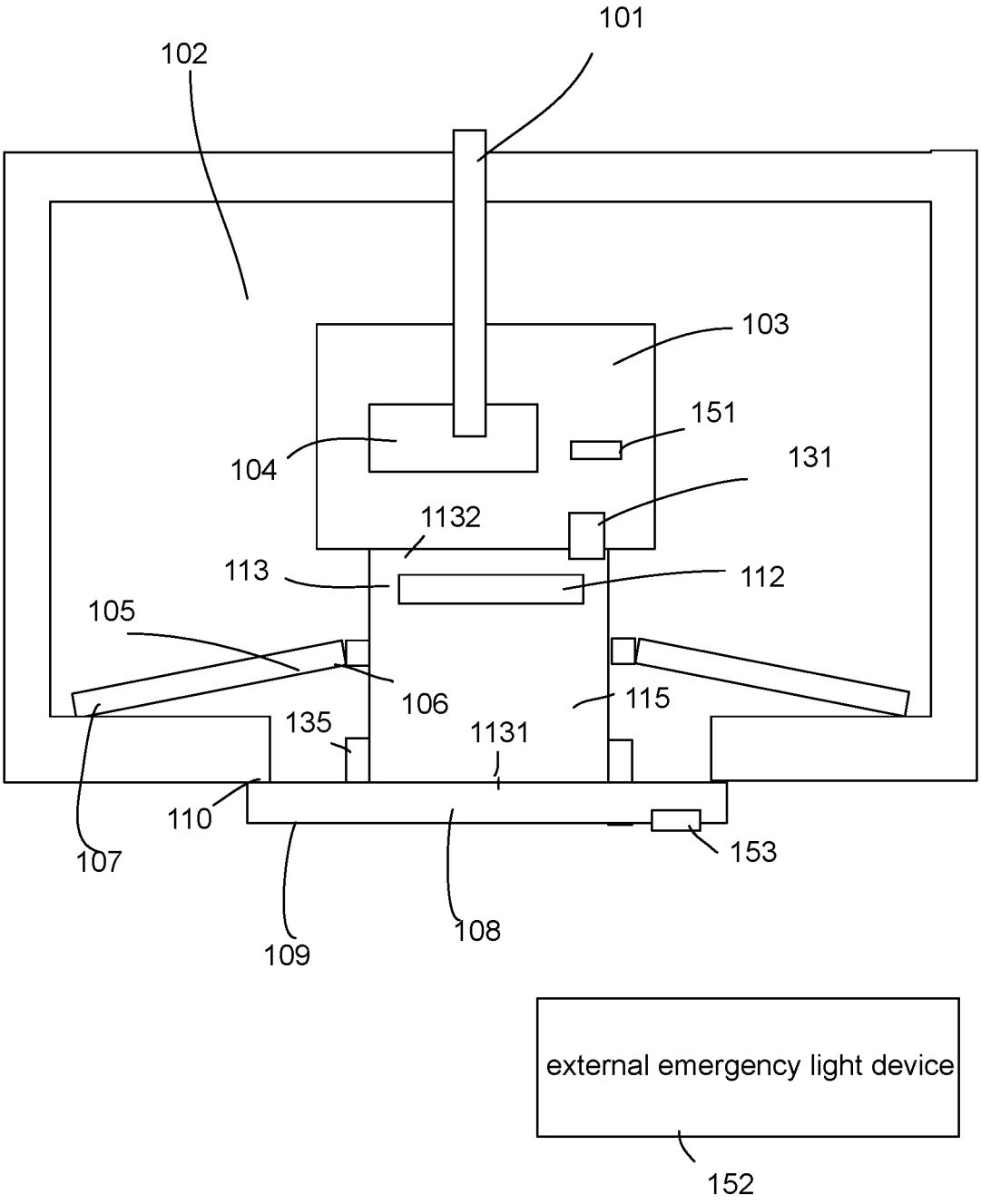
FIG. 1 illustrates a downlight apparatus embodiment.

In FIG. 1, a downlight apparatus includes a light source 112, a driver 104, a light holder 113, a metal rim 109 and two elastic arms 105.

The driver 104 converts an external power to a driving current to be used by the light source 112.

The light holder 113 stores the light source 112 in an holder space 115 of the light holder 113.

The light holder 113 is placed inside a cavity 102 of a ceiling.

The metal rim 109 is connected to a bottom side 1131 of the light holder 113.

The two elastic arms 105 are attached to one of the metal rim 109 and the light holder 113 for elastically pressing the metal rim 109 to engage an cavity edge 110 of the cavity 102 of the ceiling for concealing the cavity 102 and preventing an accidental fire to escape from the cavity 102 of the ceiling to outside of the cavity 102 of the ceiling.

In some embodiments, the downlight apparatus may also include a driver box 103 for connecting to an external power wire 101 to receive the external power.

The driver box 103 conceals the driver 104.

Figure 2:
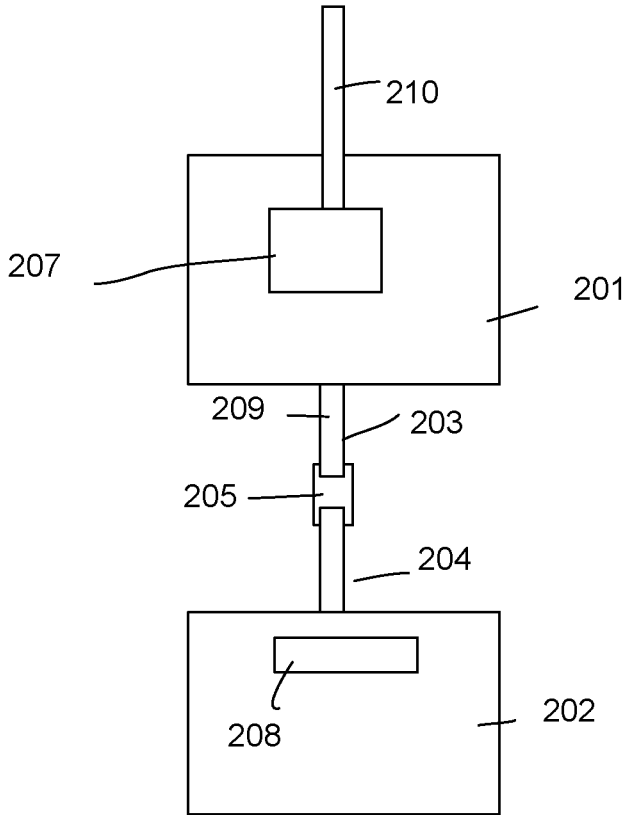
FIG. 2 shows a connection between components.

In FIG. 2, the driver box 201 is separate from the light holder 202.

The driver 207 is electrically connected to the light source 208 via an internal power wire 209.

In FIG. 2, the internal power wire 209 includes a first part 203 and a second part 204 connected with a plugging structure 205. For example, one of the first part 203 and the second part 204 may include a male terminal while the other includes a female socket so that the two parts are structurally and electrically connected via the plugging structure 205.

In some embodiments, the external power wire 210 is inserted into the driver box 201 to connect to the driver 207.

The driver box 201 is made of metal material.

In some embodiments, the driver box is stacked above the light holder, as shown in FIG. 1.

In some embodiments, the driver box 103 is attached to the light holder 113 with a buckle structure 131.

In some embodiments, the driver box 103 conceals a top side 1132 of the light holder 113 to further prevent the accidental fire to escape from the cavity 102 of the ceiling.

Figure 11:
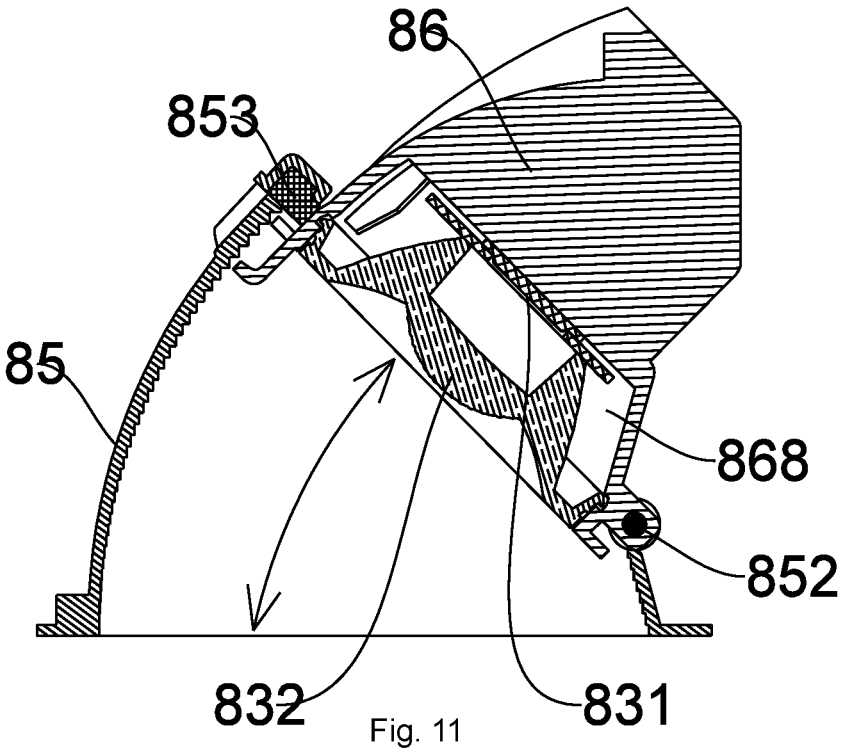
FIG. 11 shows a downlight apparatus with a spreading cup.

In FIG. 11, a spreader cup 85 is attached to the metal rim for guiding a light of a light source 831 stored in a light holder 868 from a light opening 832 of the metal rim to a different direction. The driver 86 is attached above the light holder 868.

In some embodiments, the spreader cup 85 has an inner reflective layer for guiding the light to change to the different direction.

Figure 12:
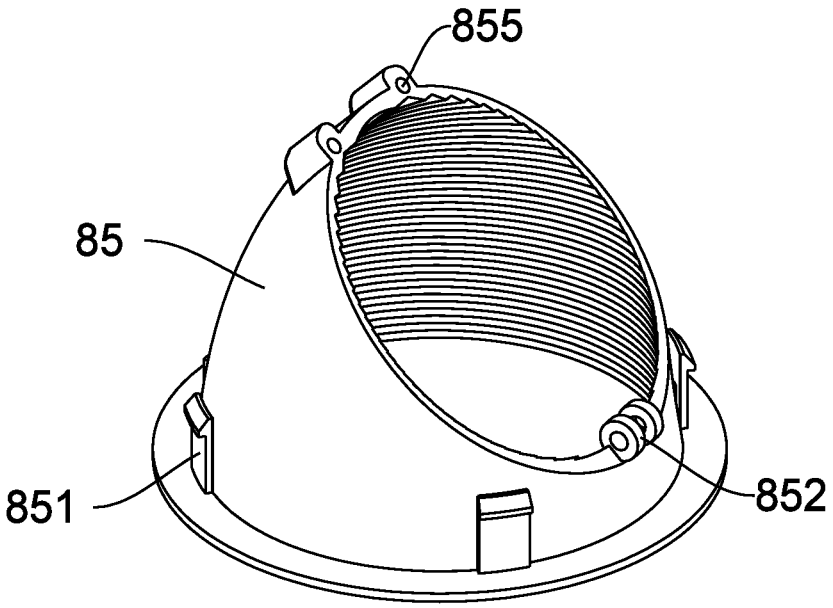
FIG. 12 shows an example of the spreading cup.

FIG. 12 shows two hinges 852, 855 are used for connecting components. The protruding block 851 is used for fixing the downlight device to a cavity. Unlike previous examples, the spreader cup may be regarded as a part of the metal rim.

Figure 13:
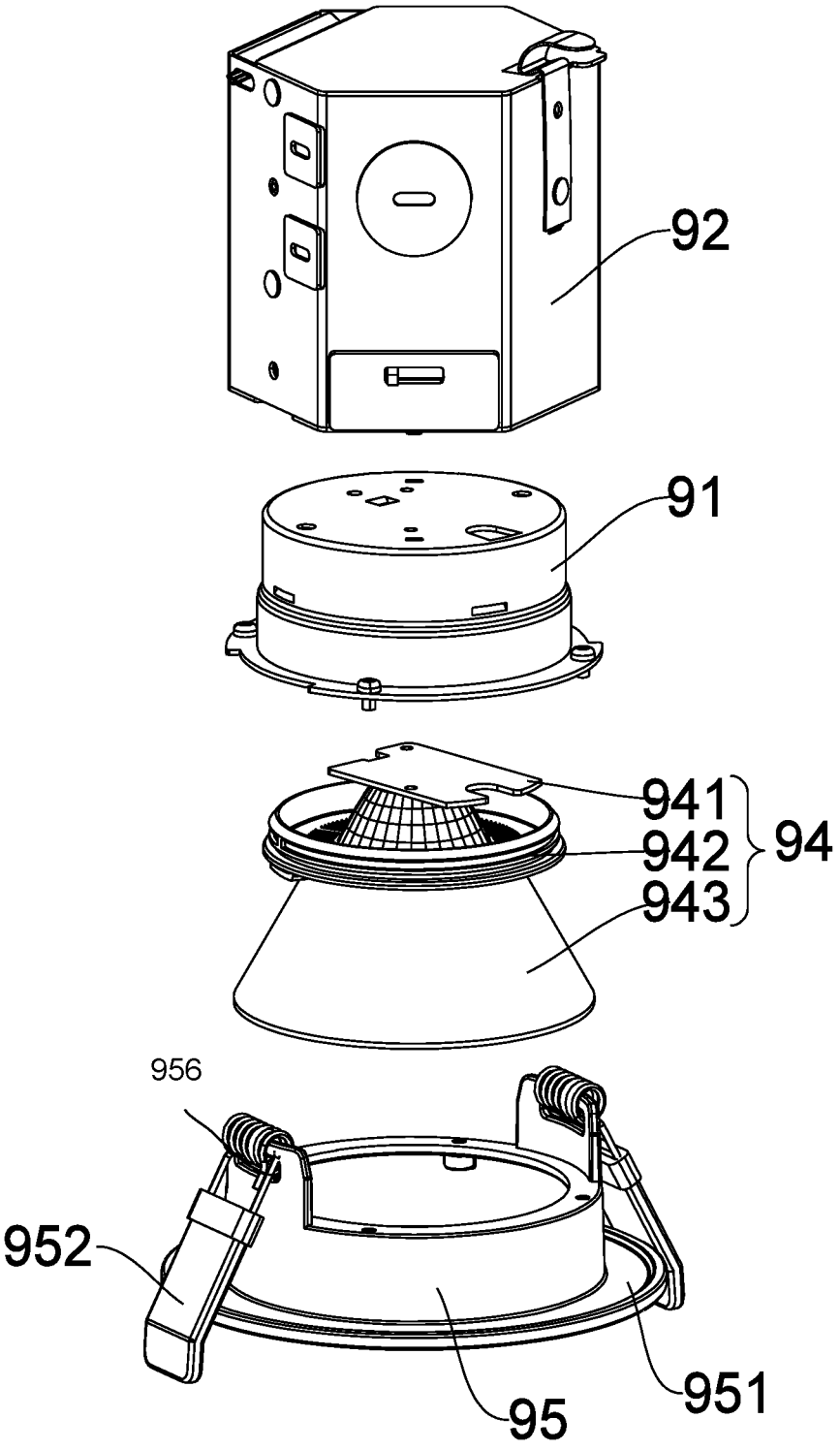
FIG. 13 shows an exploded view of another downlight apparatus.

FIG. 13 shows an exploded view of another downlight apparatus embodiment.

In FIG. 13, a driver box 92 is stacked above a light holder 91, which conceals a light source plate 941 mounted with LED modules facing to a lens unit 942 that includes reflective cup 943 forming a light source unit 94.

There is a U-shape bracket 956 for attaching a pair of elastic arms 952. The elastic arms 952 in this example are disposed on a lateral wall 95 of the metal rim 951.

Figure 10:
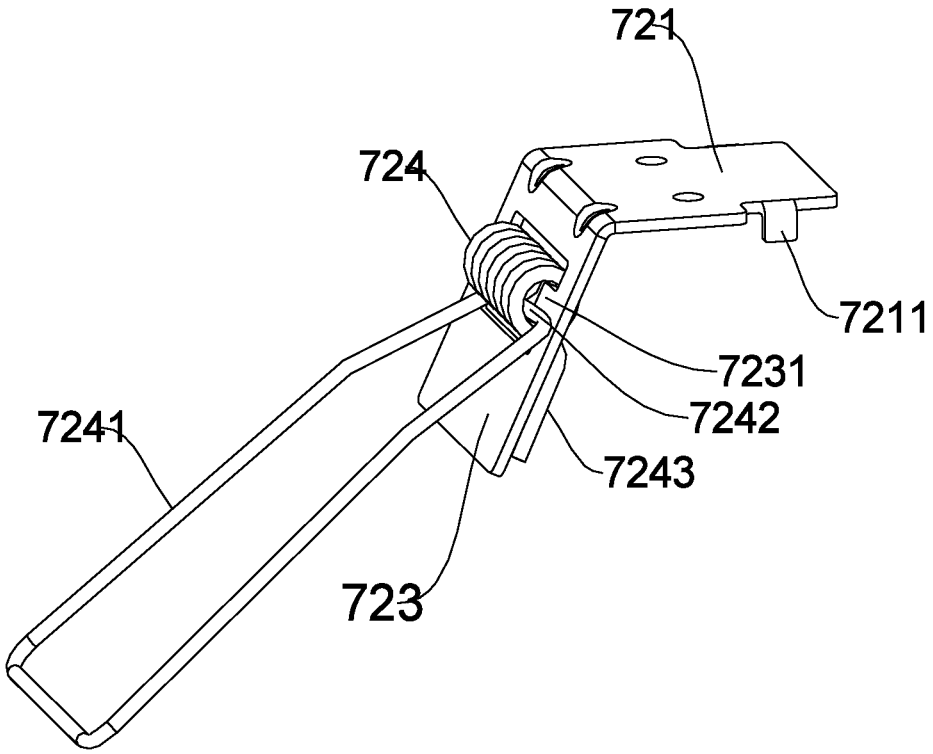
FIG. 10 shows an elastic arm example.

FIG. 10 shows a zoom-up view of the elastic arm.

In FIG. 10, a bracket 721 has a fixing pin 7211 and a receiver structure 7231, 7242. The elastic arm has a spring head 724 and an extending arm 7241. The elastic arm also has a protruding tail 7243 engaging the attaching bracket so that the spring head 724 is capable of increasing an elastic force when the extending arm 7241 is rotated along an axis of the spring head 724.

In some embodiments, the light holder is made of metal material, wherein the light holder and the metal rim together form a concealing surface for preventing any accidental fire escape from the cavity of the ceiling to pass the concealing surface.

In FIG. 1, the metal rim has a lateral wall 135 for mounting the light holder 113.

In some embodiments, the downlight apparatus may also include a temperature sensor 151 for detecting an ambient temperature.

When the ambient temperature is detected higher than a threshold, the light source 112 is turned off automatically.

In some embodiments, an indicator 153 shows a warning message when the detected ambient temperature is over the threshold.

In some embodiments, an external emergency light device 152 is activated by the driver 104 wirelessly when the detected ambient temperature is over the threshold.

Figure 3:
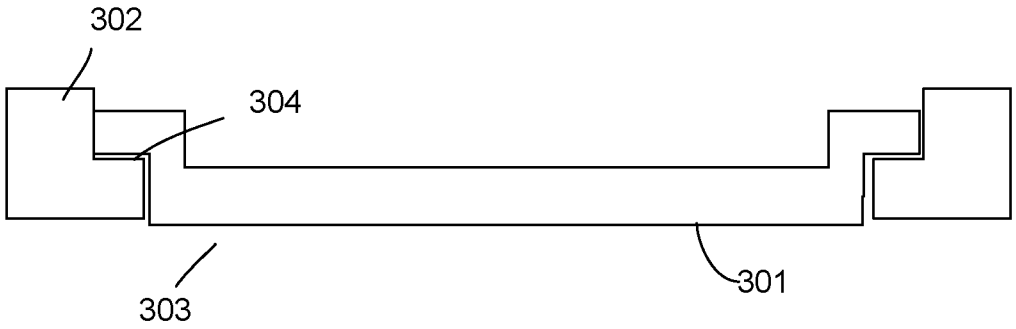
FIG. 3 shows a ladder structure example.

In FIG. 3, the downlight apparatus may also include a light passing cover 301.

The metal rim 302 defines a light opening 303 and the light passing cover 301 conceals the light opening 303.

In some embodiments, a connection of the light passing cover to the metal rim has a ladder structure 304 for preventing water to move into the light holder.

In FIG. 1, the elastic arm 105 has a spring head 106 and an extending arm 107.

The spring head 106 is attached to an U shape bracket.

In some embodiments, the spring head has a protruding tail for engaging the U shape bracket so that when the extending arm is rotated along an axis of the spring head, an elastic force is generated for elastically pressing the metal rim to engage the cavity edge of the cavity of the ceiling.

Figure 9:
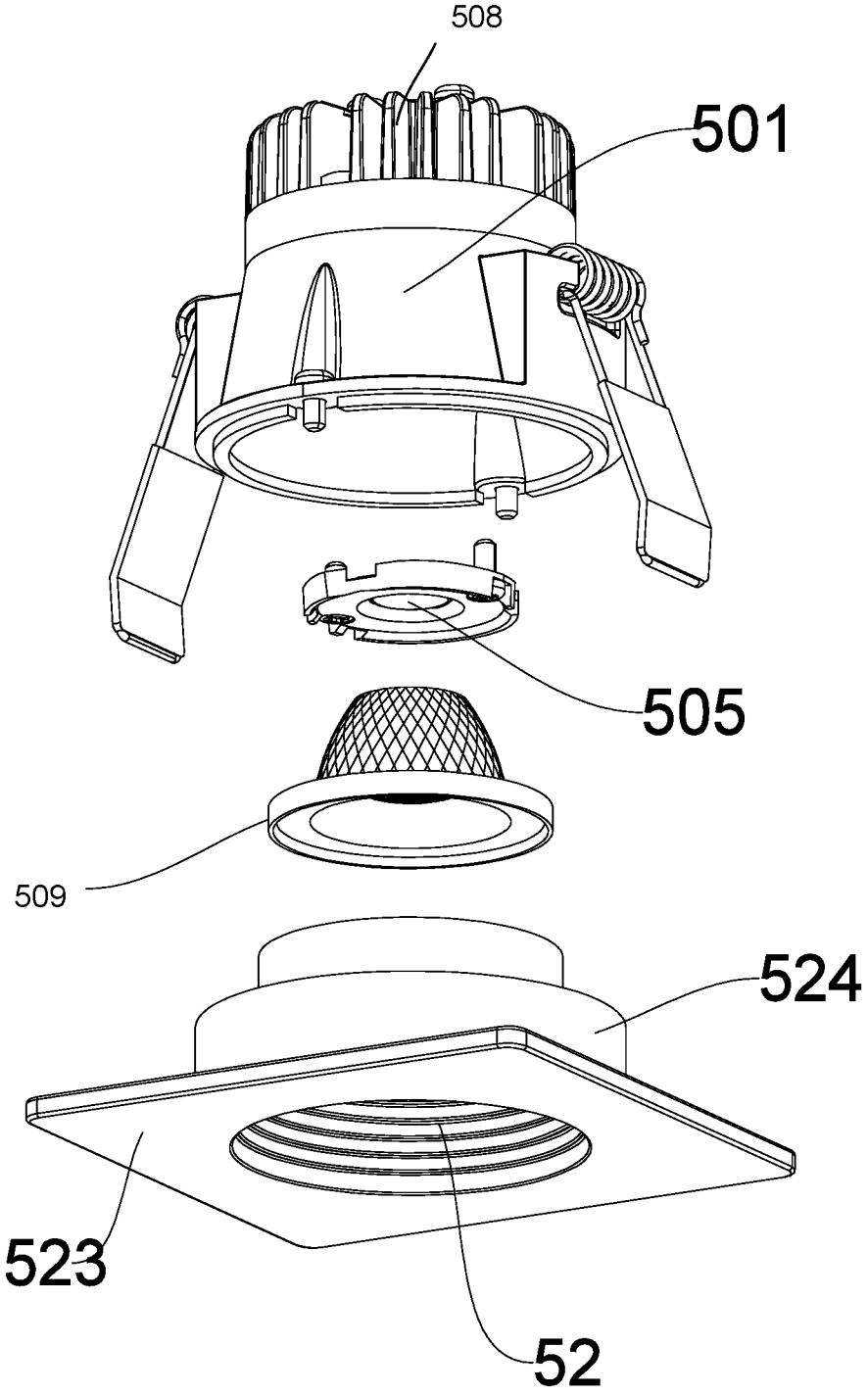
FIG. 9 shows an exploded view of another downlight apparatus example.

In FIG. 9, a metal heat sink 508 is attached on a top side of the light holder 501 to further prevent fire to penetrate from the top side of the light holder.

In FIG. 9, the light source 505 is facing to a lens 509. A metal rim 524 has a light opening 52 and a rim surface 523.

Figure 4:
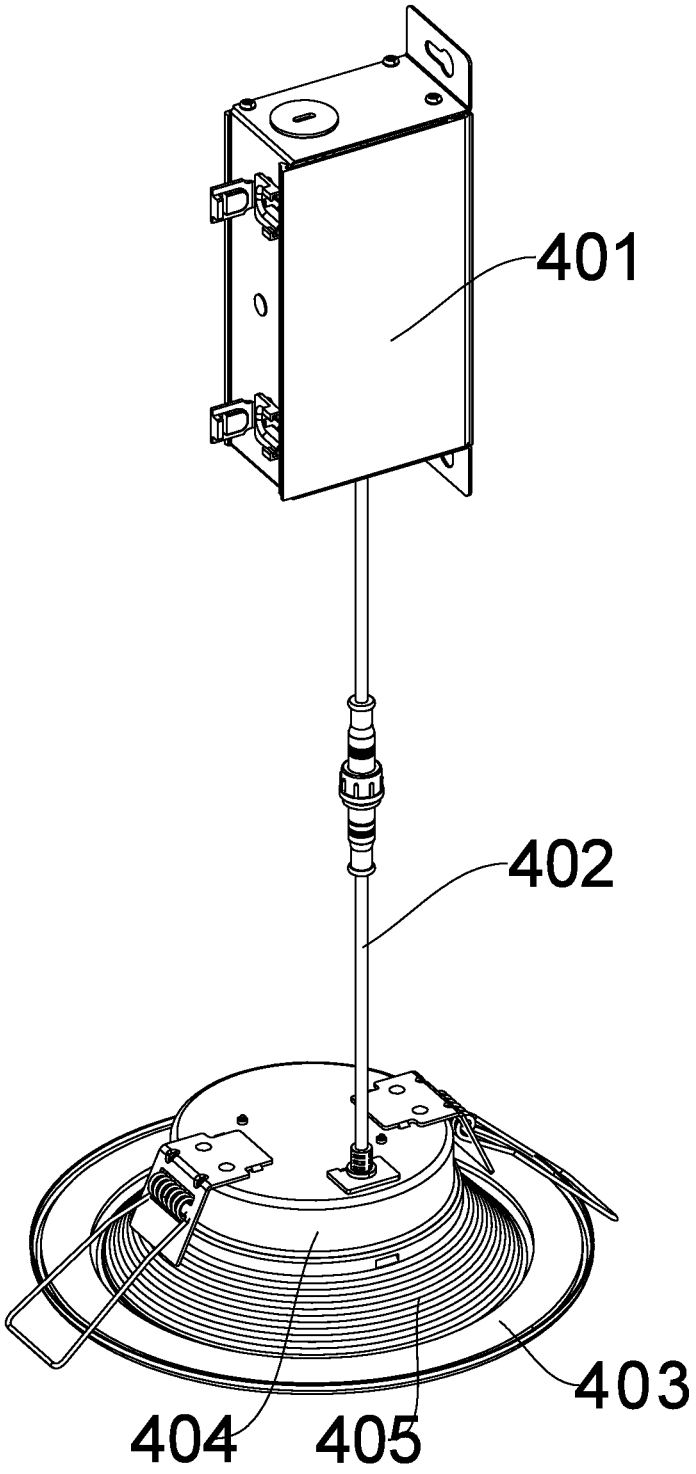
FIG. 4 shows another downlight apparatus embodiment.

FIG. 4 shows another downlight embodiment. In FIG. 4, a driver box 401 is separate from a light holder 404. The light holder 404 is connected to a metal rim 403 via a tilt ring 405.

Figure 5:
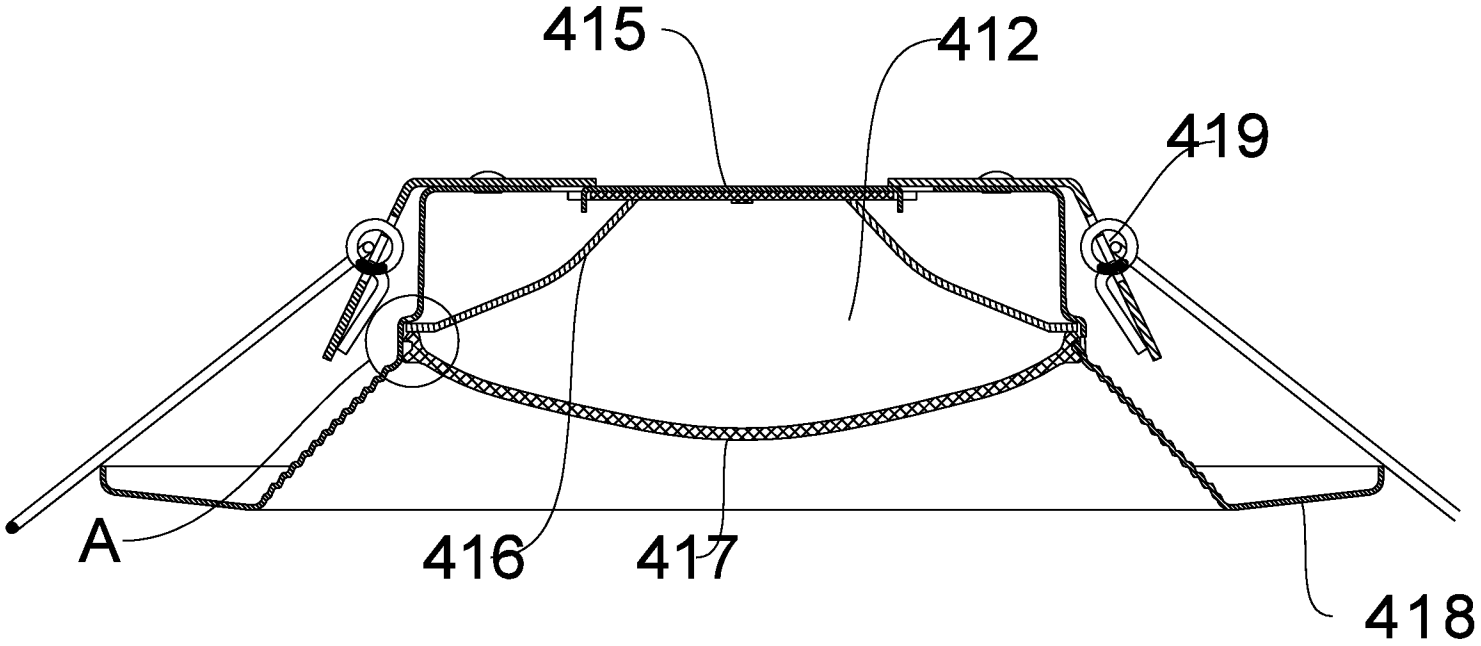
FIG. 5 shows a cross-sectional view of another downlight apparatus.

FIG. 5 shows a cross-sectional view of another downlight embodiment.

In FIG. 5, the light holder 415 has a holder space for placing a reflective cup 416. A light passing cover 417 is attached to the metal rim 418 to conceal the light opening 412. An elastic arm 419 is used for attaching the downlight apparatus to a cavity of a ceiling.

Figure 6:
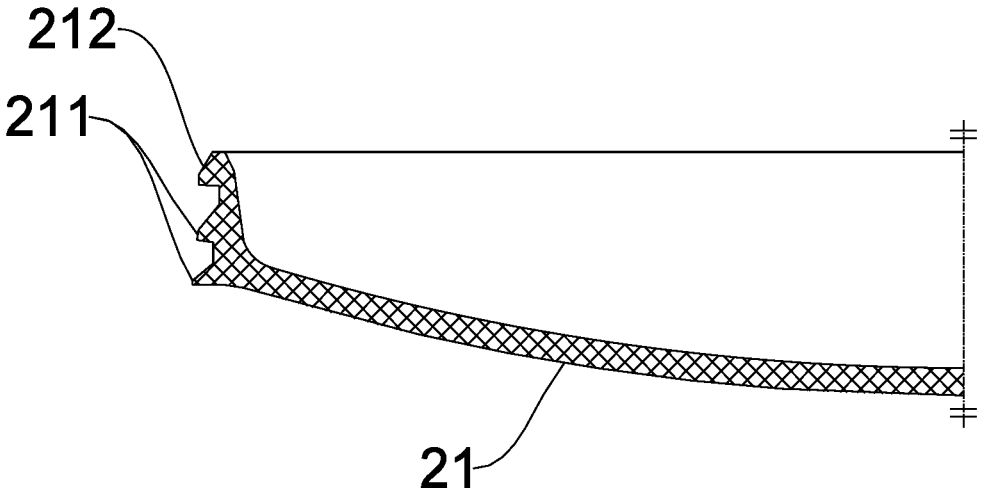
FIG. 6 shows a light passing cover.
Figure 7:
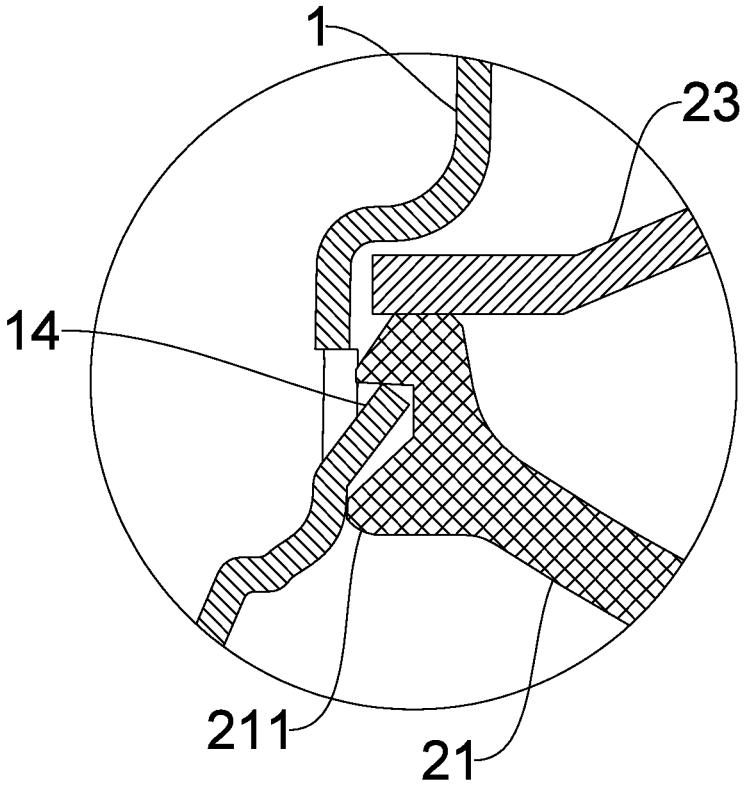
FIG. 7 shows a first connection type of a ladder structure.
Figure 8:
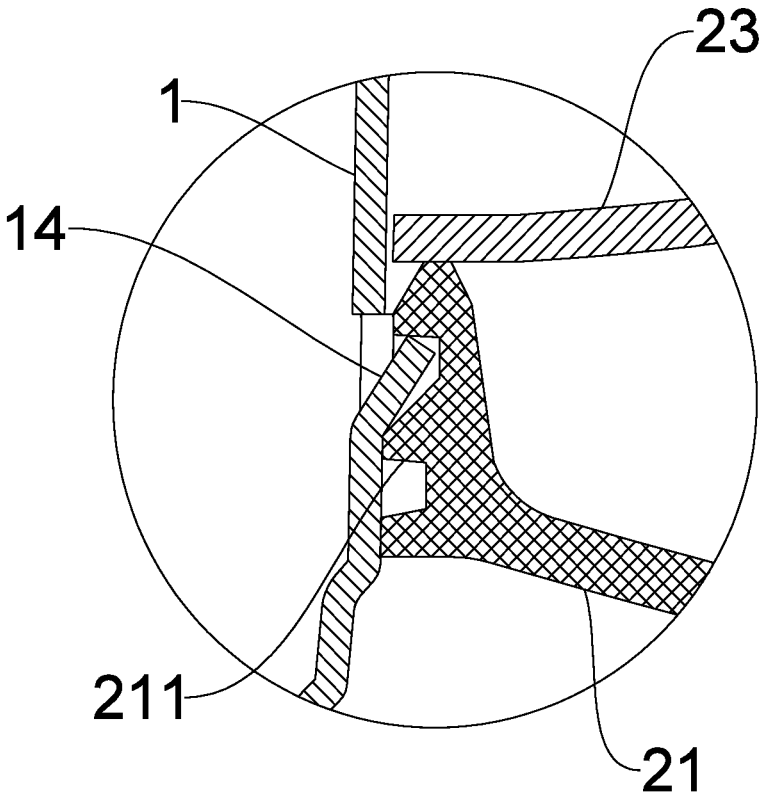
FIG. 8 shows a second connection type of another ladder structure.

FIG. 6, FIG. 7 and FIG. 8 show the light passing cover 21 with a ladder structure 211, 212 for fixing to a lateral wall of a light holder 1 and a metal rim 14.

FIG. 7 and FIG. 8 show two examples for the ladder structures and how they are used for prevent water to move into the light holder.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a light source;

a driver for converting an external power to a driving current to be used by the light source;

a light holder for disposing the light source in a holder space of the light holder, wherein the light holder is placed inside a cavity of a ceiling;

a metal rim connected to a bottom side of the light holder;

two elastic arms attached to one of the metal rim and the light holder for elastically pressing the metal rim to engage a cavity edge of the cavity of the ceiling for concealing the cavity and preventing an accidental fire to escape from the cavity of the ceiling to outside of the cavity of the ceiling; and a temperature sensor for detecting an ambient temperature, wherein when the ambient temperature is detected higher than a threshold, the light source is turned off automatically, wherein an external emergency light device is activated by the driver wirelessly when the detected ambient temperature is over the threshold.

2. The downlight apparatus of claim 1, further comprising a driver box for connecting to an external power wire to receive the external power, wherein the driver box conceals the driver.

3. The downlight apparatus of claim 2, wherein the driver box is separate from the light holder, wherein the driver is electrically connected to the light source via an internal power wire.

4. The downlight apparatus of claim 3, wherein the internal power wire comprises a first part and a second part connected with a plugging structure.

5. The downlight apparatus of claim 4, wherein the external power wire is inserted into the driver box to connect to the driver, wherein the driver box is made of metal material.

6. The downlight apparatus of claim 2, wherein the driver box is stacked above the light holder.

7. The downlight apparatus of claim 6, wherein the driver box is attached to the light holder with a buckle structure.

8. The downlight apparatus of claim 6, wherein the driver box conceals a top side of the light holder to further prevent the accidental fire to escape from the cavity of the ceiling.

9. The downlight apparatus of claim 1, wherein a spreader cup is attached to the metal rim for guiding a light from a light opening of the metal rim to a different direction.

10. The downlight apparatus of claim 9, wherein the spreader cup has an inner reflective layer for guiding the light to change to the different direction.

11. The downlight apparatus of claim 1, wherein the light holder is made of metal material, wherein the light holder and the metal rim together form a concealing surface for preventing any accidental fire escape from the cavity of the ceiling to pass the concealing surface.

12. The downlight apparatus of claim 1, wherein the metal rim has a lateral wall for mounting the light holder.

13. The downlight apparatus of claim 1, wherein an indicator shows a warning message when the detected ambient temperature is over the threshold.

14. The downlight apparatus of claim 1, further comprising a light passing cover, wherein the metal rim defines a light opening and the light passing cover conceals the light opening.

15. The downlight apparatus of claim 14, wherein a connection of the light passing cover to the metal rim has a ladder structure for preventing water to move into the light holder.

16. The downlight apparatus of claim 1, wherein the elastic arm has a spring head and an extending arm, wherein the spring head is attached to an U shape bracket.

17. The downlight apparatus of claim 16, wherein the spring head has a protruding tail for engaging the U shape bracket so that when the extending arm is rotated along an axis of the spring head, an elastic force is generated for elastically pressing the metal rim to engage the cavity edge of the cavity of the ceiling.

18. The downlight apparatus of claim 1, wherein a metal head sink is attached on a top side of the light holder to further prevent fire to penetrate from the top side of the light holder.

* * * * *